United States Patent [19]

Fletcher

[11] 4,079,552

[45] Mar. 21, 1978

[54] DIAMOND BONDING PROCESS

[76] Inventor: J. Lawrence Fletcher, 8401 Wells Rd., Westminster, Calif. 92683

[21] Appl. No.: 521,439

[22] Filed: Nov. 6, 1974

[51] Int. Cl.[2] ..... B24D 3/06; C25D 5/12

[52] U.S. Cl. ..... 51/295; 51/309 R; 204/16

[58] Field of Search ..... 51/293, 295, 309; 204/16, 32 R, 38 S, 181

[56] References Cited

U.S. PATENT DOCUMENTS

| | | | |
|---|---|---|---|
| 2,360,798 | 10/1944 | Seligman et al. | 51/309 |
| 2,784,536 | 3/1957 | Barron | 51/309 |
| 3,356,599 | 12/1967 | Weiss | 51/293 |
| 3,488,892 | 1/1970 | Benner et al. | 51/309 |
| 3,650,714 | 3/1972 | Farkas | 51/309 |
| 3,785,938 | 1/1974 | Sam | 51/309 |
| 3,973,925 | 8/1976 | Asaeda et al. | 51/309 |
| 3,985,521 | 10/1976 | Borchard et al. | 51/295 |

*Primary Examiner*—Donald J. Arnold

*Attorney, Agent, or Firm*—H. Ross Workman; J. Winslow Young

[57] ABSTRACT

A diamond bonding process wherein a metallic workpiece is pre-etched and thereafter diamond is uniformly and densely bonded to the surface of said metallic workpiece in a nickel matrix. A novel second plating of nickel metal more securely bonds the diamonds to the workpiece.

7 Claims, 2 Drawing Figures

DIAMOND BONDING PROCESS

BACKGROUND

1. Field of the Invention

This invention relates to a process for bonding diamond particles to the surface of a metal workpiece.

2. The Prior Art

The hardness and abrasive qualities of diamonds are well known, particularly those of synthetically produced polycrystalline diamond particles. Polycrystalline diamond particles are of particular interest because of their greatly increased number of sharp points or cutting edges and lack of fracture planes.

Sharpening devices have been prepared from natural diamond particles by bonding these particles together in the form of a sharpening stone using a ceramic or polymeric matrix to bond the diamond into a unitary structure. However, this process consumes an excessive amount of diamond particles. A ceramic structure is also more susceptible to fracture.

Accordingly, abrasive devices have been prepared by bonding diamond particles to the surface of a metal workpiece in an electrolytic plating bath. Workpieces produced according to this latter process have conventionally evidenced an inherent weakness in that the diamond particles tend to be pulled from the metal workpiece by abrasive action during use of the workpiece.

It would, therefore, be an improvement in the art to provide a process for securely bonding diamond particles to the surface of a metal workpiece so as to present a unitary, high bond strength surface which is less subject to wear and fracture and wherein the diamond particles are uniformly and densely bonded. Such an invention is disclosed herein.

BRIEF SUMMARY AND OBJECTS OF THE INVENTION

The present invention comprises a novel process for more securely bonding polycrystalline diamond or other abrasive particles to the surface of a metallic workpiece. The novel process of the present invention includes preceding the diamond/metal plating step with an etching step so as to suitably etch the workpiece prior to plating with the diamond/metal surface. Etching is believed to create minute cavities in the workpiece surface thereby providing for a stronger mechanical bond between the diamond/metal plated surface and the workpiece.

Thereafter, the workpiece is electroplated with a suspension of diamond particles in an aqueous solution of metal ions to bond the diamond particles to the workpiece. The diamond/metal bonding process step is followed by a further plating step wherein a veneer of metal is bonded around the diamond and over the metal surface to thereby more securely bond the diamond particles to the workpiece surface. Heat treatment after the second plating step serves to relax stresses in the plated surfaces and thereby provide a stronger bonded surface on the workpiece.

It is therefore a primary object of this invention to provide improvements in diamond plating processes.

It is an even further object of this invention to provide improvements in plating diamond particles to a metal workpiece surface.

These and other objects and features of the present invention will become more fully apparent from the following description and appended claims taken in conjunction with the accompanying drawing.

DETAILED DESCRIPTION OF THE PREFERRED EMBODIMENT

Figure 1:
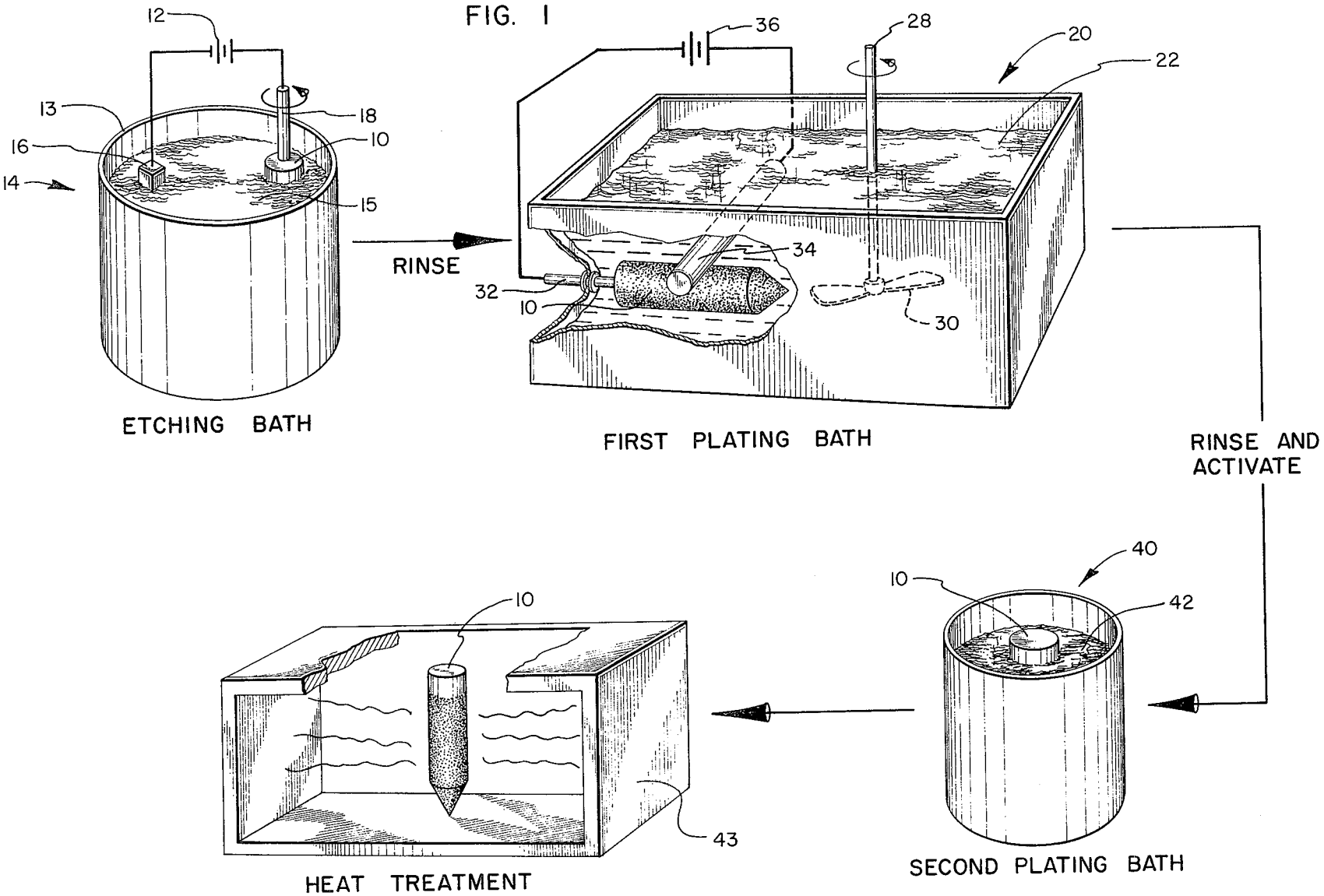
FIG. 1 is a schematic flow diagram demonstrating one presently preferred technique for preparing the diamond/metal plated workpiece of the present invention.

The invention is best understood by reference to the drawing wherein like parts are designated with like numerals throughout. The process of this invention is applicable to bonding any of a wide variety of abrasive particles, for example, diamond, boron nitride, silicon carbide and the like. For convenience, the process of this application will be described using diamond particles.

A plated workpiece with diamond particles advantageously incorporates the durability of diamond with the versatility of a metal substrate. While natural diamond or static synthesis diamond grit can be used, synthetically produced polycrystalline diamond grit or particles are particularly useful due to their increased surface irregularities as compared to natural or static synthesis diamond particles.

Plating these diamond particles onto the surface of a metal workpiece provides a workpiece with an abrasive surface useful for many grinding and lapping applications, for example, those found in grinding wheels, lapping wheels, hones, tool sharpeners, etc.

In the foregoing applications, it is readily apparent that considerable stress is placed on each diamond particle during use of the workpiece. This stress tends to loosen and eventually break the diamond particle from the surface of the workpiece. These stresses also tend to break apart and tear loose the metal with which the diamond particles have been bonded to the surface of the workpiece. It has been found that this latter problem may be alleviated to some degree by etching the workpiece surface prior to plating with diamonds and metal so as to create cavities therein. The cavities form a pocket to receive a significant portion of a diamond particle so that much of the diamond particle is recessed out of the shear plane formed along the surface of the workpiece. The cavities also assist in forming a stronger mechanical bond between the workpiece and the plated surface.

According to the illustrated embodiment of the present invention, a layer of diamond particles are bonded to the surface of a metal workpiece through the action of simultaneously plating nickel metal to the workpiece. Diamond particles do not, in themselves, electroplate on the metal workpiece but are entrapped by the nickel metal as it is electroplated thereon.

Uniform dispersion of diamond particles is assured by constant agitation of the electroplating bath while an electromotive force imposed upon the bath assists in attracting the diamond particles to the workpiece, thereby enhancing the close, uniform packing of diamond particles on the workpiece surface. Constant agitation is herein defined to mean continuous agitation or periodic agitation adequate to maintain dispersion of the diamond particles.

After a predetermined layer of diamond particles have been bonded to the surface of the workpiece by the plating action of the metal, the workpiece is immersed in a second plating bath where a surface of metal only is deposited over the diamond/metal surface. This second coating of metal has the surprising advantage of more securely bonding the diamond particles to the workpiece, particularly those diamond particles that adhered to the workpiece during the latter stages of the previous plating step.

The second plating step is then followed by heat treatment of the workpiece so as to harden and toughen the metal and relax any stresses that may have developed during any of the previous processing steps. Importantly, the temperature during heat treatment is held below the decomposition temperature of the diamond particles to preclude thermal decomposition.

Referring to the drawing, a workpiece 10 is shown in an etching bath 14 comprising a solution 15 of aqueous sulfuric acid. One suitable etching solution has a 60% sulfuric acid concentration. To assist in the etching of workpiece 10, an electromotive force indicated at 12 is imposed between workpiece 10 and a cathode 16 or even a metal vessel 13 containing the acid solution 15. A reverse D.C. current of about 4 amps at 5 to 6 volts for 6 or 7 minutes has been found adequate. To improve uniformity in the etching process, workpiece 10 is preferably rotated in the bath with a rotatable shaft 18. Rotation of shaft 18 and workpiece 10 also agitates the solution and minimizes undesirable concentration of electrolytic action of any one portion of the surface of the workpiece thereby assuring more uniform etching.

After etching, any remaining sulfuric acid is removed by rinsing workpiece 10 with water. The workpiece 10 is then placed in a first plating bath generally designated 20.

Plating bath 20 contains a nickel plating solution 22 which may be a standard aqueous solution of nickel sulfate and nickel chloride heated to about 120° F. This plating solution is well known in the art and is commonly referred to as a standard Watts bath. Conventionally the plating solution includes about 15 to 50 ounces per gallon (113.1 to 377.2 grams per liter) nickel sulfate and 8 to 40 ounces per gallon (60.3 to 301.7 grams per liter) nickel chloride in a boric acid buffer. Diamond particles are suspended in the aqueous solution 22 so as to facilitate uniform distribution of diamond particles on workpiece 10. Diamond particles may be of any suitable size although the very fine particles (24 to 41microns) are preferred for sharpening tools and the like. Grinding wheels and related tools may require particle sizes upwards of 100 mesh. Diamond concentration of about 10–50% by volume was found to be most efficient to effect essentially uniform diamond distribution over the workpiece. Suspension of diamond particles is maintained by vigorously agitating bath 22. In the illustrated embodiment, there is shown a conventional stirring device 26 which includes, for example, an impeller 30 mounted upon a rotatable shaft 28 and driven by a motor (not shown). Alternatively, the solution 22 can be agitated hydraulically, electromechanically or with vibration. The flow of fluid and diamond particles caused by agitation advantageously serves to dislodge gas bubbles appearing at the workpiece during the course of electrolysis.

Workpiece 10 is mounted upon a rotatable shaft 32 and suspended in plating bath 20. Substantial improvement in diamond plating has been found where the surface to be plated is situated out of the vertical plane. For example, it is presently preferred that the workpiece 10 be oriented horizontally in the electroplating bath. It is presently believed that non-vertical orientation permits the suspended diamonds to be aided by gravity in coming to rest upon and being secured by the electrodeposition of nickel. While any number of angles with respect to the vertical appear to be effective, the horizontal is most effective. A nickel anode 34 is also suspended in plating bath 20. An electromotive force is applied through circuit 36 between workpiece 10 and anode 34 with workpiece 10 connected to circuit 36 so as to act as a cathode. Workpiece 10 is plated with nickel metal ions. The plating action simultaneously entraps diamond particles 24 on the surface of workpiece 10 and the plated nickel metal serves to mechanically bond diamond particles 24 to the surface of workpiece 10.

Figure 2:
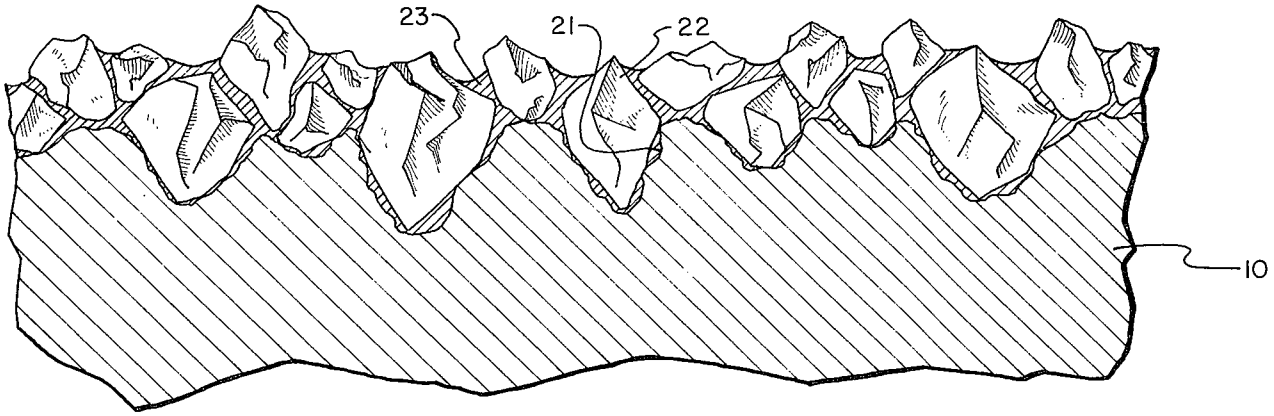
FIG. 2 is a schematic cross-section of a workpiece diamond plated according to the presently preferred embodiment of the invention

The cavities 21 (FIG. 2) created in workpiece 10 during the etching step also greatly assist in forming a strong bond between workpiece 10 and the diamond-/nickel matrix 23. Moreover, many of the diamond particles 22 are recessed into the cavities so as to limit their exposure to a small area in the shear plane formed along the diamond/metal surface. The diamonds 22 thus secured have surprising resistance to shear and breakage away from the workpiece 10.

Rotation of workpiece 10 in bath 20 assures a more uniform plating of metal thereon and agitation by rotation of impeller 30 assures an even dispersion of diamond particles throughout electroplating bath 20 and, accordingly, on the surface of workpiece 10. It has also been discovered that the imposition of an electromotive force through circuit 36 appears to cause an attraction between diamond particles and workpiece 10 so as to more densely pack diamond particles on the surface of workpiece 10. The thickness and concentration of the diamond particles can be determined by the duration of the electroplating step. Approximately six minutes has been found satisfactory.

After suitably electroplating the diamond particles to the surface of workpiece 10, workpiece 10 is removed from the plating bath and rinsed with water to remove any unplated residue from bath 20. While not essential, it has been found desirable to follow the rinsing step with an activation step wherein the diamond plated workpiece is treated by dipping or rinsing in a 50% hydrochloric acid solution prior to immersing the workpiece in a second plating bath 40. Surface activation is primarily used where the workpiece surface has been oxidized. If care is taken to avoid drying of the workpiece 10 during the etching and electroplating process, activation can usually be avoided. Prior to treatment in the second plating bath 40, the diamond adheres to the workpiece 10 as a soft pack.

The second plating bath 40 comprises an electroless nickel plating solution 42 of nickel ions. Any suitable electroless plating solution could be used such as solutions marketed by the Allied Kelite Division of Richardson Chemical Co. (Product No. 794 A, B and HZ). The workpiece is held in this electroless plating bath for sufficient time to achieve a suitable coating, for example, approximately 70 to 80 minutes has been found adequate. The temperature in the electroless plating bath is elevated to about 195° F or such other elevated temperature as may be recommended by the manufacturer of the solution. It is pointed out that while electroless plating is preferred electrolytic plating may be used. Nickel plating in this bath has been found to deposit about 0.0008 inches nickel per hour (0.02 millimeters per hour) in this bath and it is presently preferred to substantially interfill the surface area around the diamonds and/or cover the diamond adhering to the workpiece.

After removal from the second or electroless plating bath 40, workpiece 10 is cleaned with water, dried and then subjected to heat treatment e.g. in a furnace 43 wherein workpiece 10 is heated to approximately 600° F for approximately 1 hour. Heat treatment between 650° and 750° F for one hour yields a workpiece having a Rockwell C-Scale hardness of 72. Hardness of 46 to 72 has been found desirable. The actual hardness achieved is a function of both temperature and firing time.

Among the novel features of the present invention are included the steps of suitably etching minute cavities in the surface of workpiece 10; constantly agitating the diamond particles in the first plating bath 20 so as to provide a uniform dispersion and uniform plating of diamond particles; and the second plating bath wherein a second nickel metal coating is applied over the initial diamond/metal coating. THe foregoing novel steps have provided a surprisingly stronger bond of diamond particles to the workpiece surface.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A process for bonding abrasive particles to a metal surface comprising the steps of:

obtaining a metal workpiece;

preparing the workpiece by first chemically etching the surface to form cavities therein of sufficient size to receive a portion of the abrasive particle;

suspending abrasive particles in a first plating bath comprising an aqueous solution of nickel ions and constantly agitating the bath to maintain suspension of the abrasive particles;

placing the prepared workpiece and a nickel anode in the plating bath and imposing an electromotive force between the workpiece and the anode so as to cause a substantial portion of the abrasive particles to become individually partially embedded in the cavities of the etched surface of the workpiece as nickel is plated onto the workpiece and around the embedded particles;

removing the abrasive plated workpiece from the plating bath and subjecting the workpiece to aqueous rinse;

immersing the abrasive plated workpiece in a second plating bath comprising an aqueous solution of nickel ions so as to form a second surface of nickel metal around the partially embedded abrasive particles; and heat treating the workpiece after removal from the second plating bath.

2. A process as defined in claim 1 wherein immersing the abrasive plated workpiece is preceded by activation by exposing to an acid wash.

3. A process as defined in claim 1 wherein said plating step comprises orienting the surface to be plated out of the vertical plane.

4. A process as defined in claim 1 wherein the plating step includes rotating the workpiece while applying the electromotive force.

5. A process as defined in claim 1 wherein the immersing step includes placing the workpiece in an electroless plating bath as the second plating bath.

6. A process as defined in claim 1 wherein said heat treating step includes heating the workpiece to a temperature below the decomposition temperature of the abrasive particle until predetermined hardness is achieved.

7. A process for bonding abrasive particles to the surface of a metal workpiece, the proess comprising the steps of:

chemically etching the surface of the workpiece so as to form cavities therein, said cavities generally being large enough to receive only a portion of one of the abrasive particles;

suspending the abrasive particles in a first plating bath comprising an aqueous solution of metal ions;

agitating the bath at least periodically to suspend the abrasive particles;

placing the etched workpiece and a metal anode in the first plating bath and imposing an electromotive force across the anode and workpiece so as to cause abrasive particles to become individually partially embedded in the cavities of the etched surface of the workpiece as metal is placed onto the workpiece and around the embedded particles; and placing the workpiece in a second bath comprising an aqueous solution of metal ions and plating a second coat of metal around the partially embedded abrasive particles.

* * * * *

UNITED STATES PATENT AND TRADEMARK OFFICE

CERTIFICATE OF CORRECTION

PATENT NO. : 4,079,552

DATED : March 21, 1978

INVENTOR(S) : J. Lawrence Fletcher

It is certified that error appears in the above-identified patent and that said Letters Patent are hereby corrected as shown below:

Column 5, line 15, after "650°", insert --F--

Column 5, line 26, "THe" should be --The--

Column 6, line 48, "placed" should be --plated--.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*